United States Patent [19]

Alinari

[11] 4,056,010

[45] Nov. 1, 1977

[54] INSTRUMENT FOR INDICATING THE DEPTHS AND DURATIONS OF DECOMPRESSION STOPS REQUIRED DURING UNDERWATER SUBMERSIONS

[76] Inventor: Carlo Alinari, Corso Vittorio Emanuele, 200 - Turin, Italy

[21] Appl. No.: 646,105

[22] Filed: Jan. 2, 1976

[30] Foreign Application Priority Data

Jan. 17, 1975 Italy ..... 67101/75

[51] Int. Cl.[2] ..... G06G 5/00; G01F 23/14

[52] U.S. Cl. ..... 73/432 R

[58] Field of Search ..... 73/432 R, 300

[56] References Cited

U.S. PATENT DOCUMENTS

| | | | |
|---|---|---|---|
| 3,121,333 | 2/1964 | Alinari | 73/432 R UX |
| 3,457,393 | 7/1969 | Stubbs et al. | 73/432 R UX |
| 3,463,015 | 8/1969 | Gulino et al. | 73/432 R |
| 3,777,573 | 12/1973 | Alinari | 73/432 R |
| 3,886,801 | 6/1975 | Hills | 73/432 R |
| 3,933,049 | 1/1976 | Shamlian et al. | 73/432 R |

*Primary Examiner*—Richard C. Queisser
*Assistant Examiner*—Joseph W. Roskos
*Attorney, Agent, or Firm*—Sughrue, Rothwell, Mion, Zinn and Macpeak

[57] ABSTRACT

An instrument for indicating the depths and durations of the decompression stops required to be made by a diver during an ascent from an underwater dive is disclosed. The instrument comprises a transparent rigid cylindrical chamber linked to a chamber having at least one resilient wall by a restrictor which allows only a very slow transfer of gas from one chamber to the other. Within the rigid chamber is a pressure indicator comprising a transparent or semi-transparent pipe one end of which is sealed and the other end of which is open to the interior of the rigid chamber. A piston is slidably housed in the pipe and moves along it in dependence on the pressure in the rigid chamber, the position of the piston forming a visible indication of the pressure.

5 Claims, 3 Drawing Figures

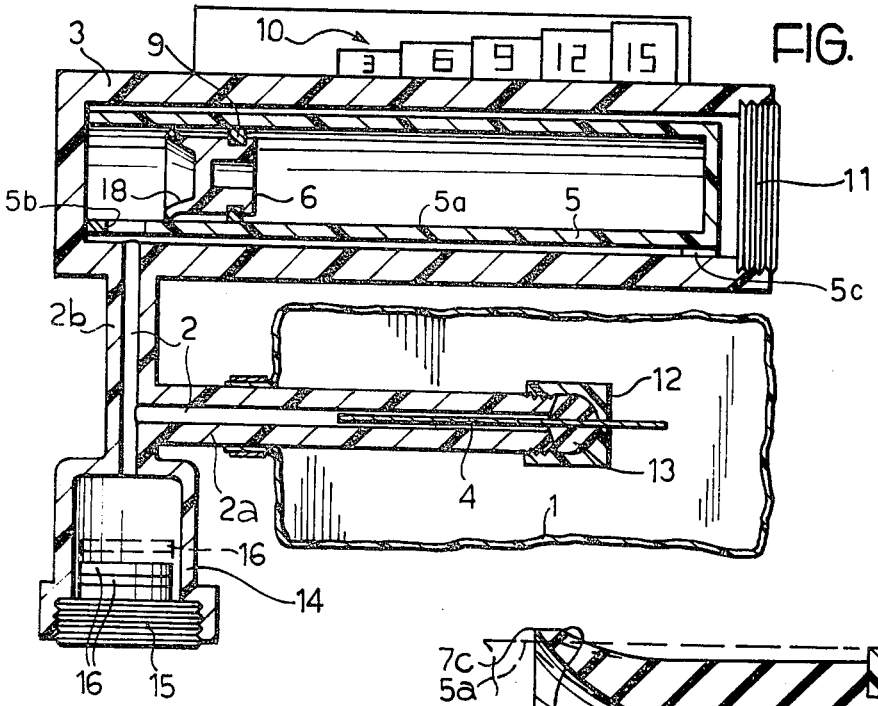
FIG. 1
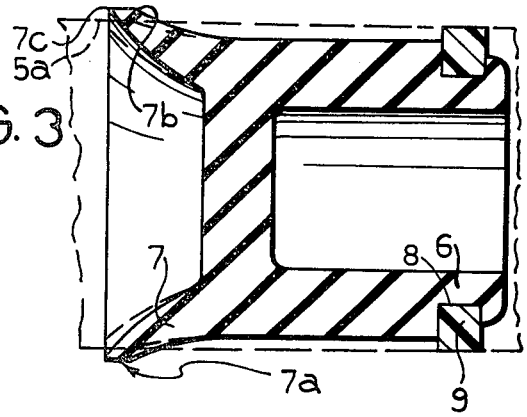
FIG. 3
FIG. 2
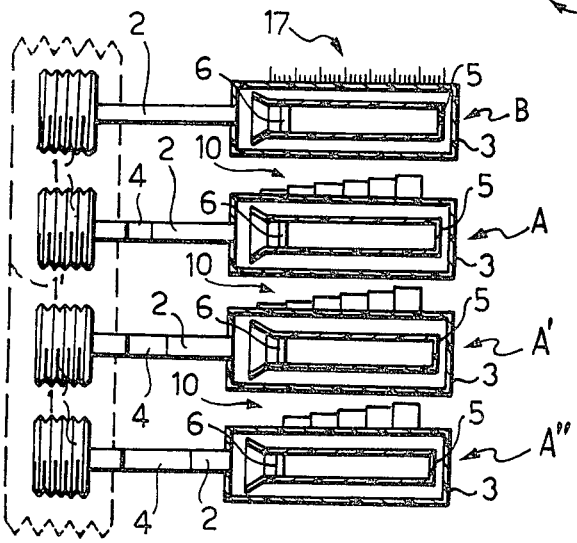

INSTRUMENT FOR INDICATING THE DEPTHS AND DURATIONS OF DECOMPRESSION STOPS REQUIRED DURING UNDERWATER SUBMERSIONS

The present invention relates to decompression meters, that is instruments which can be used for determining the depth and duration of decompression stops which must be made during an ascent from an underwater submersion, or dive, performed with breathing apparatus.

One known instrument for this purpose is described in Italian Pat. No. 624,174; this instrument includes a deformable chamber which in use of the instrument is exposed to the ambient pressure and which is connected by a constricted neck to a rigid (or in practice non-resilient under operating conditions) chamber filled, like the resilient chamber, with gas. The instrument is fitted with means for indicating the depth and duration of the required decompression stops in dependence on the pressure prevailing in the rigid chamber, this being possible because the neck joining the deformable chamber to the rigid chamber is such that the pressure variations in the rigid chamber simulate the behaviour of human tissue insofar as it relates to the variation of the nitrogen pressure contained therein during the decompression arising from ascent from a dive. The gas may be replaced by a liquid if the rigid chamber is provided with a resilient membrane.

In order to indicate the depths and durations of the required decompression stops, use is made of manometers fitted with appropriate scales, in particular a Bourdon tube manometer is used in practice. However, this makes the instrument fairly cumbersome and rather costly.

Also known (from Italian Patent 935,741) is an instrument for the same purpose, which includes a sliding piston sealed in a cylinder of rigid material so that it separates the interior of the cylinder into two chambers. One chamber of the cylinder contains gas and the other contains a viscous liquid and is connected by a narrow passageway or neck to a resilient chamber, also containing the viscous liquid; the plunger is subjected to the action of a spring which opposes those displacements of the cylinder which reduce the volume in the chamber of the cylinder which contains gas. For indicating the depths and durations of the required decompression stops, a manometer is supplied, this being connected to that chamber of the cylinder which contains gas. Such an instrument has a number of disadvantages: the use of a spring to resist the movement of the plunger increases the cost and bulk of the instrument, and the measurement error is proportional to the pressure because the gaskets carried by the plunger only work well in conditions of equal pressure.

It is possible to make a plurality of such instruments as a battery in which the neck of each instrument is constructed in such a way that each instrument provides an indication related to the behaviour of a particular tissue of the human body during submersion and the subsequent decompression upon ascending. Using the known constructional forms, however, it is not possible to obtain batteries of acceptable size and cost. This is also true of the apparatus described in Italian Pat. No. 624,174, by reason of the size of the manometers which measure the pressure in the rigid chamber, and which are provided with scales which indicate the depths at which decompression stops are required during ascent in order to avoid the risk of embolism.

According to the present invention there is provided an instrument for determining the depths and durations of decompression stops required to be made by a diver when ascending from an underwater submersion, of the type comprising a first chamber having a resilient wall connected by a restrictor to a second chamber having rigid walls, in which the second chamber is formed as a transparent cylinder within which is housed a coaxial pipe made from a material which is at least semi-transparent, the said semi-transparent pipe being open at one end for communication with the interior of the second chamber, a piston being slidingly and sealingly housed within the bore in the pipe so that the position of the piston along the pipe represents the pressure at any time within the said second chamber, which latter is provided with a scale against which the positions of the piston can be referred in determining the depth and duration of decompression stops required during an ascent.

The scale carried on or by the second chamber is preferably marked with a plurality of predetermined depths in such a way that the position of the piston along the scale indicates the level to which a diver can safely rise before the next decompression stop is required. If the diver then rises to that level and stops the piston will slowly move to indicate the level at which the next decompression stop should be made; because of the slow transfer of fluid through the restrictor the piston will not have moved far from its original position when the diver reaches the new level and the time it takes to reach the next position is the time for which the decompression stop should last. The position of the piston along the scale thus directly indicates the depth at which the decompression stop should be made, and the required duration of the decompression stop is indicated by the time taken for the piston to move to a position indicating the next level at which the next decompression stop should be made.

One embodiment of the present invention will now be more particularly described, by way of example, with reference to the accompanying drawings, in which:

FIG. 1 is an axial section of a decompression meter constructed in accordance with the invention;

FIG. 2 is a diagrammatic axial section illustrating a battery of instruments such as are illustrated in FIG. 1; and FIG. 3 is an axial section, on an enlarged scale, of a construction detail of the decompression meter illustrated in FIG. 1.

Referring now to the drawings there is shown an instrument having a chamber 1, formed of a resilient material, the interior of which is connected to a rigid chamber 3 of transparent material by a pipe 2 having two branches 2*a* and 2*b* extending at right angles to one another. The pipe 2 communicates with the resilient chamber 1 through a restrictor 4 which acts to slow down the flow of fluid between the two chambers. The restrictor 4 may be a small bar of ceramic material held in place by means of a threaded cap 12 and sealed by means of a seal 13.

A tube 5 of semi-transparent material (for example, a polypropylene known by the trade name of "Moplen" made by Soc. Montedison) is housed within the rigid chamber 3, with a very small amount of radial play. This has been exaggerated in the drawings in order clearly to show the individual elements forming the structure. The tube 5 has an opening 5*b* at one end through which it communicates with the interior of the rigid chamber 3. The other end of the tube 5 is closed and is secured to the wall of the chamber 3, for example by a weld 5*c.* The wall thickness of the tube 5 is about 1 mm., and within the bore of the tube 5 is mounted, for sliding movement, a piston 6 of elastomeric material (for example this may be of synthetic rubber) the outside diameter of which is less than the internal diameter of the tube 5. The piston 6 has a recess 18 at one end defined by a skirt 7 extending in bell form and having a cylindrical annular rim 7*a* which is coaxial with the piston 6. The diameter of the annular rim 7*a* of the skirt 7 is a little larger (see FIG. 3) than the internal diameter of the tube 5, so that when the piston is located within the tube 5 the rim 7*a* presses outwardly to form a seal between the piston 6 and the tube 5. The rim 7*a* is delimited by two annular edges 7*b,* 7*c,* and the outward pressure of the skirt 7 ensures that one of the edges 7*b,* 7*c* of the rim 7*a* is always in contact with the internal wall 5*a* of tube 5 even though the other edge may be slightly displaced by the burr that inevitably forms during the sliding movement of the piston 6, particularly when moving towards the left of the drawing when there will be a tendency for the skirt 7*a* to roll up. Around the periphery of piston 6, a short distance from the other end of the piston 6, there is machined a groove 8 in which is housed a coloured ring 9, also made, for example, of "Moplen" (Registered Trade Mark), which serves as another sealing ring for the plunger and which is visible from outside the tube 5 so that it forms a reference index, indicating the position of the piston 6.

Since the two chambers 1 and 3, the tube 5 and the pipe 2, are full of a gas, for example air, any variation in pressure within the rigid chamber 3 causes a displacement of piston 6 along the tube 5 in such a way as to establish a balance position between the pressure inside the tube 5 and the pressure in the chamber 3 outside the tube 5.

The system thus operates so as to maintain substantially constantly equal the pressures on the opposite sides of the piston 6 and this is a very favourable condition for the seal formed by the lip 7 of the piston 6, because the friction is less than in known instruments and does not vary appreciably with the variations of the pressure in the chamber 3. Moreover, this also avoids distortion of the thin pipe 5, which distortion could upset the proper operation of the instrument.

Due to the transparency of the chamber 3 and to the semi-transparency of the tube 5, the coloured ring 9 carried on the piston 6 will be visible from outside the chamber and can indicate, by reference to a scale 10, the depths and durations of the required decompression stops. The rigid chamber 3 is sealed at one end by a plug 11 which permits the introduction of the tube 5 into the chamber 3.

The branch pipe 2*b* communicates with a compensation chamber 14 which is closed by a plug 15 and into which are inserted discs 16 of inert and incompressible material for the purpose of varying the overall volume of fluid in the two chambers 1 and 3. By varying the number of discs 16 it is possible to calibrate the instrument.

By appropriately selecting the length and diameter of the restrictor 4 it is possible to adapt the behaviour of the instrument under variations in pressure to correspond to that of various tissues of the human body. It is thus possible to form a battery of instruments A, A′, A″ . . . , as illustrated in FIG. 2, each of which can be used, in conjunction with a depth meter, to determine the decompression stops required for each tissue of the human body represented. The battery of instruments may have a plurality of resilient chambers 1, one for each instrument, or may incorporate a common resilient chamber 1′. In the battery of instruments shown in FIG. 2 there is one, indicated by the reference B, which does not have a restrictor 4 in the passage 2. The position of the piston 6 in the instrument B thus directly represents the depth of submersion of the instrument, and it is provided with a scale 17 directly reading depth. A diver ascending from a dive can determine the decompression stops required by reference to the instrument B and the instruments A, A′, A″. The piston 6 which indicates the greatest depth at any one time must be considered when determining when to make a decompression stop. For example if the instrument A″ indicates the greatest depth, the next decompression stop will be made when the instrument B indicates the same depth as the instrument A″. If the diver wants to make a further ascent he must choose again the indication of an instrument which now indicates the greatest depth, and which may be another of the instruments A, A′, A″ (for example the instrument A). The instrument B will inform the diver in each case when he has reached the depth at which he should effect a decompression stop.

I claim:

1. In an instrument for determining the depths and durations of decompression stops required to be made by a diver when ascending after a submarine dive, of the type including:

a first chamber having a resilient wall, a second chamber having rigid walls, means interconnecting said first and second chambers, said interconnecting means including a restrictor throttle for delaying the transfer of gas from one chamber to the other upon the occurrence of changes in the pressure to which they are both subject;

the improvement wherein said second chamber is formed as a cylindrical chamber of a transparent material, an inner cylinder is housed coaxially within the cylinder comprising said second chamber, said inner cylinder being at least semi-transparent and communicating with said second chamber through an opening at one end of said inner cylinder, the other end of said inner cylinder being closed, a piston slidingly and sealingly housed in said inner cylinder, the position of said piston being observable from outside said second chamber and representing the pressure obtaining at any time within said second chamber, and a fixed scale on said rigid chamber against which the position of said piston can be compared to determine the depth and duration of decompression stops required.

2. The instrument of claim 1, wherein said piston has an annular peripheral groove adjacent one end thereof, a ring of a color contrasting that of the body of said piston being housed in said groove, said ring serving as an index mark.

3. The instrument of claim 1, wherein said piston is resilient and formed with a flared skirt at one end thereof, the rim of said skirt having a cylindrical surface coaxial with the body of said piston, the diameter of said cylindrical surface when said piston is unstressed being slightly larger than the inner diameter of said pipe whereby said skirt is radially compressed upon insertion of said piston into said pipe.

4. The instrument of claim 1 wherein there is further provided a calibration chamber in communication with said second chamber, said calibration chamber housing a plurality of removable substantially incompressible bodies the number of which determines the precise volume of gas in said instrument whereby calibration of the instrument can be effected by removing from or adding to said removable bodies in said calibration chamber.

5. A battery of instruments comprising at least one instrument according to claim 1 and a further such instrument which differs from the first in that there is no restrictor throttle between said first and second chambers and there is a scale attached to said second chamber marked directly to indicate the depth at which the battery of instruments is located.

* * * * *